US005838350A

United States Patent [19]

Newcombe et al.

[11] Patent Number: 5,838,350

[45] Date of Patent: Nov. 17, 1998

[54] APPARATUS FOR GENERATING DROPLETS OF FLUID

[75] Inventors: Guy Charles Fernley Newcombe; Victor Carey Humberstone; Keith Gardner; Peter John Taylor, all of Cambridge, United Kingdom

[73] Assignee: The Technology Partnership PLC, Hertfordshire, United Kingdom

[21] Appl. No.: 530,244

[22] PCT Filed: Mar. 31, 1994

[86] PCT No.: PCT/GB94/00688

§ 371 Date: Sep. 28, 1995

§ 102(e) Date: Sep. 28, 1995

[87] PCT Pub. No.: WO94/22592

PCT Pub. Date: Oct. 13, 1994

[30] Foreign Application Priority Data

Mar. 31, 1993 [GB] United Kingdom ..... 9306680

[51] Int. Cl.[6] ..... B41J 2/045

[52] U.S. Cl. ..... 347/68

[58] Field of Search ..... 347/68, 69, 73, 347/70

[56] References Cited

U.S. PATENT DOCUMENTS

| | | | |
|---|---|---|---|
| 3,683,212 | 8/1972 | Zoltan . | |
| 3,804,329 | 4/1974 | Martner . | |
| 4,294,407 | 10/1981 | Reichl et al. . | |
| 5,124,716 | 6/1992 | Roy et al. | 346/1.1 |
| 5,502,472 | 3/1996 | Suzuki | 347/69 |
| 5,505,364 | 4/1996 | Plesinger | 228/121 |
| 5,563,634 | 10/1996 | Fujii et al. | 347/9 |

FOREIGN PATENT DOCUMENTS

| | | |
|---|---|---|
| 0 049 636 A1 | 10/1981 | European Pat. Off. . |
| 0 077 636 B1 | 4/1986 | European Pat. Off. . |
| 0 480 615 A1 | 10/1991 | European Pat. Off. . |
| WO 93/10910 | 6/1993 | WIPO . |

*Primary Examiner*—Edward Tso

*Attorney, Agent, or Firm*—Watson Cole Grindle Watson P.L.L.C.

[57] ABSTRACT

A device for generating droplets of fluid has a fluid supply reservoir and an electromechanical transducer. Electrodes are arranged to cause expansion and contraction of the transducer in a dimension perpendicular to the applied electric field. A perforated element is coupled for movement with the expansion and contraction of the transducer and is positioned for contact with the fluid supply for dispensing droplets therethrough.

26 Claims, 15 Drawing Sheets

APPARATUS FOR GENERATING DROPLETS OF FLUID

BACKGROUND OF THE INVENTION

This invention relates to apparatus and methods for the production of droplets by means of an electromechanical actuator.

A number of processes exist for the generation of droplets using electromechanical actuation. For many of these systems, the overall size of the equipment is considerable, with diameters of 20 mm or above (see Toda EP-A-0 480 615, Maehara EP-A-0 049 636 & EP-A-0 077 636).

There are a number of applications where such a large size makes the product unsuitable or inconvenient. For example when dispensing drugs intra-nasally it is desirable that the generator can fit inside the nostril. In the related area of hand-held droplet generators, for example ink-jet pens, air brushes, eye droppers and perfume dispensers, it is desirable to have a light and compact structure that can be easily manipulated and stored by the user.

It is an object of this invention to provide a droplet generation apparatus that can be made compact and of relatively low overall diameter.

It is a further object of this invention to provide an apparatus that generates a well defined droplet pattern with relatively high electrical efficiency.

It is a further object of this invention to provide an apparatus that may be driven from a compact electrical circuit and power source.

SUMMARY OF THE INVENTION

According to a first aspect of the present invention there is provided a device for generating droplets of fluid, the device comprising a fluid supply means;

an electromechanical transducer having electrodes arranged so as to cause expansion or contraction of the transducer in a dimension perpendicular to the applied electric field; and an element coupled for movement with the expansion/contraction of the transducer in the direction of the given dimension and positioned for contact with fluid from the supply means.

According to a second aspect of the invention there is provided a device for generating droplets of fluid, the device comprising an electromechanical transducer;

a fluid supply means; and an element coupled for movement with the transducer and positioned for contact with fluid from the supply means;

wherein the movable element is removably mounted relative to the transducer.

The movable element may be a perforate plate, but may alternatively be imperforate and have, for example, a profiled surface.

Preferably, the dimension in which the transducer is expandable or contractible is much greater than at least one other dimension of the transducer.

In one type of device, the transducer may be tubular and is expandable or contractible in the direction of its central axis. This (and other constructions in accordance with the invention) enable a uniform electric field to be provided in the thickness or radial direction so as to provide a strain that is largely independent of thickness. Thus the transducer or actuator is caused to operate in an extensional mode.

Alternatively, the transducer may be disc-shaped or annular and is expandable or contractible in the radial direction.

The supply means is advantageously in the form of a collapsible thin-walled structure partially bounding the fluid and may comprise a fluid reservoir.

The movable element is preferably connected with the fluid supply means and/or reservoir to form a replaceable sub-assembly or fluid cartridge assembly.

The fluid reservoir may be in the form of a collapsible thin-walled structure.

The present invention provides a relatively compact device which generates a defined droplet pattern on demand.

A suitable power source will be provided for the actuator/transducer including whatever means are needed, e.g. electronics and electrical circuitry, to produce the desired electrical drive for the actuator.

A manually operated switch can be provided for actuating the electronics. The switch may be mechanical or electronic. Such an electronic switch may be actuated by a timer or by a sensor or by other means.

The devices of the invention may have the transducer electrodes disposed across those two surfaces which give the shortest inter-electrode distance, and the transducer may have a dimension which is much greater than that inter-electrode distance, so that it is the extension of that large dimension of the actuator that is used to excite the perforate membrane.

Forms of the piezoelectric (or electrostrictive) actuator/transducer include a plate, a rectangular cross-sectioned rod and a hollow tube with length greater than the separation between its inner and outer radii. In the case of the hollow tube the electrodes are situated on the inner and outer walls and the device is poled radially. In the case of a rectangular cross-sectioned rod the electrodes are situated on the two closest faces. The benefit of this feature is that a given linear displacement of the actuator may be achieved by a smaller applied voltage. Conveniently, the device may be run continuously at a frequency at which the displacements in the larger dimension of the actuator are in mechanical resonance. This may be at frequencies such that the resonance may be thought of as acoustic or ultrasonic resonance modes of the device. Where the perforate structure induces only a perturbation to the electromechanical characteristics of the actuator (or in the complementary case where the electromechanical actuator induces only perturbations to the mechanical characteristics of the perforate membrane) the device may be run close to one of the piezo resonances or close to one of the perforate structure resonances. Alternatively the device may be run in a single pulse (drop on demand) mode.

The perforate structure may be formed from a variety of materials including electroformed nickel, etched silicon, stainless steel or plastics. It may be flexible or stiff. A flexible design is one where the amplitudes of the vibrational modes of the perforate structure are large compared with those of the electromechanical actuator and this motion may have a significant effect on the droplet generation process. A stiff design is one where the amplitudes of the vibrational modes of the perforate structure are closely equal to or smaller than those of the electromechanical actuator and in whch this motion, generally, follows the motion of the actuator. The flexibility may be controlled by a choice of material and thickness. The benefit of this design is that, unlike a device which depends on a bending mode, a stiff perforate structure will give uniform droplet ejection across its surface without causing a dampening of the overall motion.

If a flexible membrane is used the spray pattern may be controlled by choice of the drive frequency. For example in the case of a flexible membrane attached to a hollow tube transducer and inducing only perturbations in its motion we can obtain ejection primarily from the membrane centre by driving the piezo close to a plate resonance of the membrane. Alternatively we can obtain ejection primarily from the region close to the membrane circumference by driving the piezo at a length resonance of the electromechanical actuator.

Further control of the spray may be obtained by doming or otherwise shaping the perforate structure.

The principle of operation is as follows:

Fluid is supplied to one side of the perforate member either in the form of a drop or by some continuous feed mechanism. Suitable feed mechanisms are disclosed in our international patent application no. PCT/GB92/02262. The fluid may be at ambient pressure, slightly below ambient pressure or slightly above ambient pressure.

The electromechanical actuator is then driven using the drive electronics. The drive may be in the form of continuous sine waves, other continuous waves, single pulses, trains of pulses, single synthesised waveforms, trains of single synthesised waveforms.

The linear actuator motion excites a corresponding linear motion in the perforate structure. This motion in the perforate structure causes droplets to form and travel away from the perforate structure.

It is believed that the droplet ejection is caused by the transient pressure induced in the fluid directly behind perforate structure by the motion of that perforate structure into the fluid. This is in contrast to other ink jet production schemes such as that disclosed by Zoltan (U.S. Pat. No. 3,683,212) where the pressure is induced in the fluid by compression of the fluid volume by a piezoelectric device. The benefit of the proposed scheme is that the fluid pressure is generated locally to the orifice(s) and that there is almost no time lag between the motion of the orifice and the pressure generation. This allows drop on demand operation with a higher repetition rate than is obtained in devices such as Zoltan's.

BRIEF DESCRIPTION OF THE DRAWINGS

Various examples will now be described with reference to the accompanying drawings, in which.

DESCRIPTION OF THE INVENTION

Figure 1:
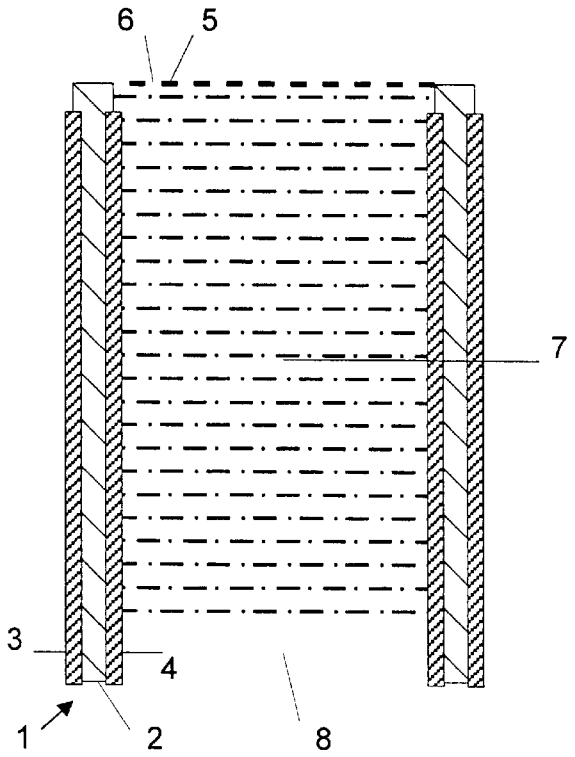
FIG. 1 illustrates the operation of a first embodiment of this invention in longitudinal section.

The actuator 1 is constructed from a hollow tube 2 of piezoelectric ceramic material. The tube has separate electrodes 3,4 on the inner and outer walls and is poled radially. The electrodes may excite length modes of the tube or a mode of the perforate structure, ie in operation the device may be driven at a frequency that corresponds to a resonance of either the nozzle plate, the piezoelectric ceramic, or the composite structure. In this way, large displacements and accelerations of the perforate membrane 5 (see below) may be generated by applying a relatively small voltage.

In order to maximise the electro-mechanical coupling to the desired mode it may be useful to shape the drive electrodes appropriately.

It may also be useful to incorporate a sense electrode into the design. This sense electrode can give phase and amplitude information that allows an appropriate electronic circuit to lock on to the correct resonant mode. Again it may be advantageous to shape the sense electrode so as to achieve appropriate electromechanical coupling.

The electrodes may be patterned so as to incorporate "drive" and "sense" electrodes. The drive and sense electrodes are electrically insulated but mechanically coupled through the peizo itself. The drive voltage is applied to the drive electrode and the resulting motion generates a voltage at the sense electrode. This voltage can then be monitored and used to control the drive through an analogue or digital feedback circuit. The induced voltage will have an amplitude and phase in relation to the drive signal. This electrical response may be used to lock onto specified resonances either by phase locking or by amplitude maximising or by some other means. Thus the device may be maintained in the length resonance irrespective of inter-device variations or of fluid loading.

A perforate membrane 5 is bonded, using an adhesive, for example Permabond E34 epoxy, to one end of the actuator 1 may be formed from a variety of materials including electroformed nickel. The perforate membrane includes orifices 6 (which may be tapered) set out on a hexagonal lattice. The droplet size may be determined by varying the exit of the orifices diameter, typically between 3 and 200 microns. The perforate membrane is usually mounted so that the fluid mass 7 to be dispensed as droplets lies against the side of the structure with the larger orifices.

In operation the tube is filled with fluid 7, preferably in a manner such that no air bubbles lie in the fluid between the perforate membrane and the fluid-air meniscus at the other, open end 8 of the tube. The piezoelectric actuator may be driven with an oscillating voltage at one of the resonant frequencies of the system or alternatively with a waveform that gives drop-on demand operation. The perforate structure is accordingly moved up and down. It is believed that a resultant pressure is induced in the fluid directly behind the perforate structure 5 and that this forces fluid through the orifices 6 to form droplets. Similarly single pulse drive may be employed to produce individual or multiple droplets on demand. As the droplets are dispensed the fluid moves up the tube so allowing continuous controlled operation until the tube is exhausted of fluid.

In a typical device the piezoelectric tube is made from piezoelectric ceramic from Morgan Unilator of the UK (PC 5), has an internal diameter of 3.2 mm, an external diameter of 4.2 mm and a total length of 11.7 mm. The orifice plate is made from electro-formed nickel. It has a diameter of 4.0 mm, thickness 60 microns. It contains tapered orifices with "entry" and "exit" diameters of 100 and 10 microns, respectively, laid out on a hexagonal lattice with lattice spacing 140 microns.

The device may be driven at a number of resonant modes of the composite structure. In the example given above the mode coupling is small and these modes may be considered to be those of the piezo or those of the nozzle plate independently. In that example, suitable modes include the piezo length mode around 106 kHz or the nozzle plate mode around 130 kHz.

Figure 2:
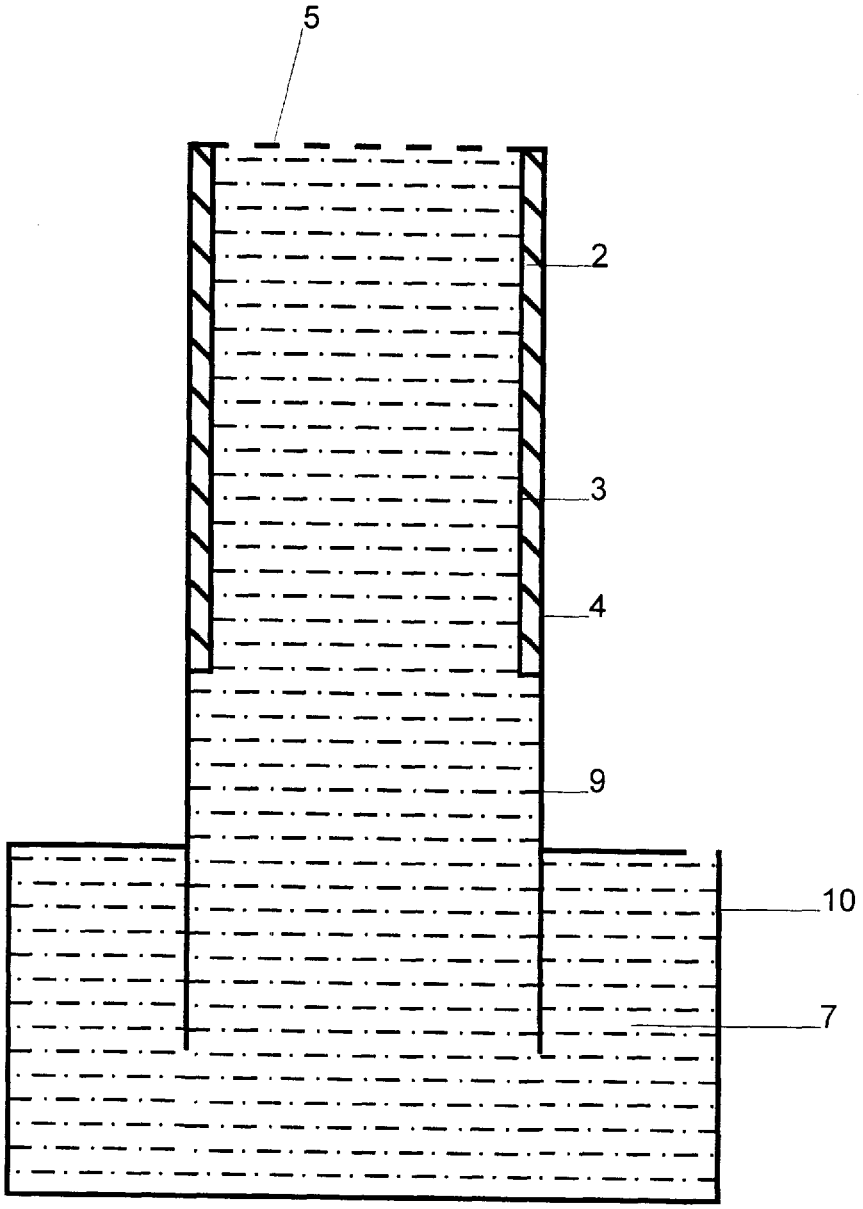
FIG. 2 shows a section of a further example with a simple fluid feed tube.

In many applications continuous fluid feed will be desired. This may be provided by a simple feed tube 9 as illustrated in FIG. 2. Here fluid is sucked up the feed tube from a reservoir 10 by the action of droplet dispensation from the membrane. Air is prevented from passing through the orifices by the fluid's surface tension.

Figure 2A:
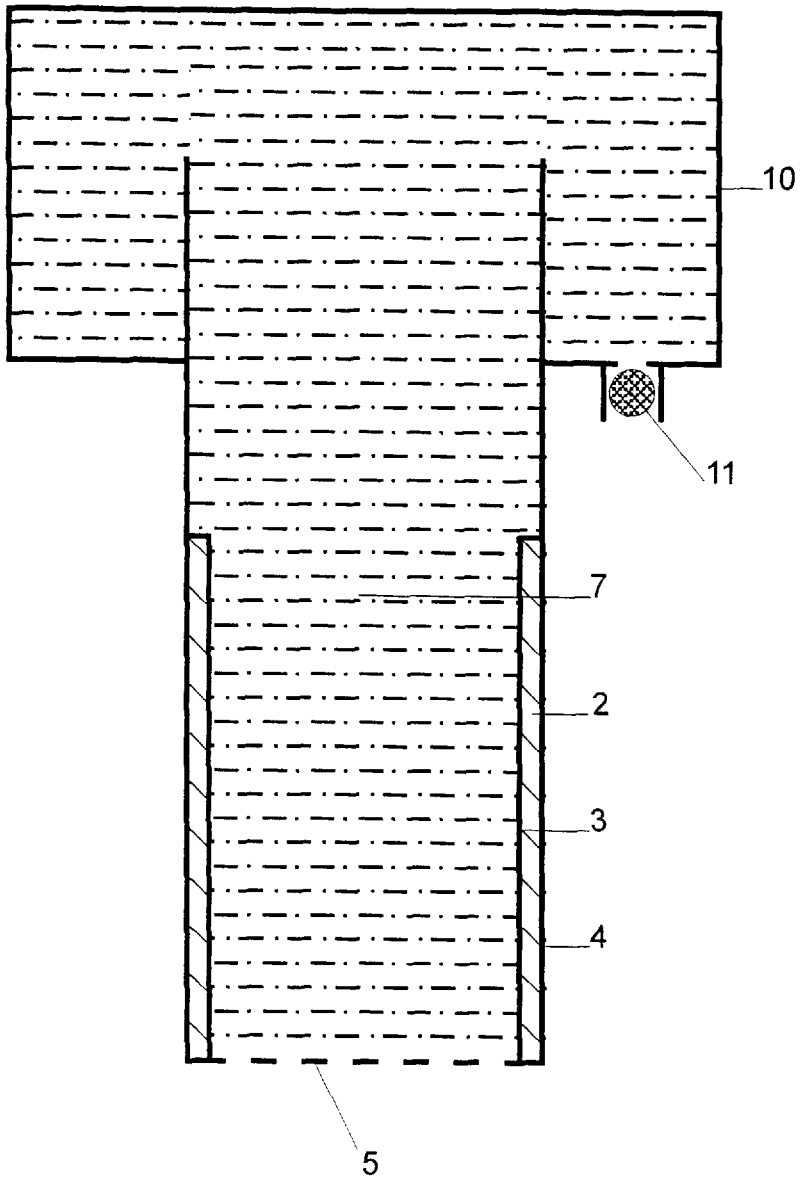
FIG. 2*a* shows a modification of the design of FIG. 2.

FIG. 2*a* shows a design appropriate to an ink jet pen or similar device where the perforate structure 5 lies below the liquid reservoir 10. Here the fluid is held at a pressure sufficiently below ambient to prevent it leaking through the orifices of the perforate structure. Air is admitted by a bubbler or similar device 11, well known in the arts of ink jet printing and writing instruments, that maintains the pressure differential between the reservoir and the ambient air.

Figure 3:
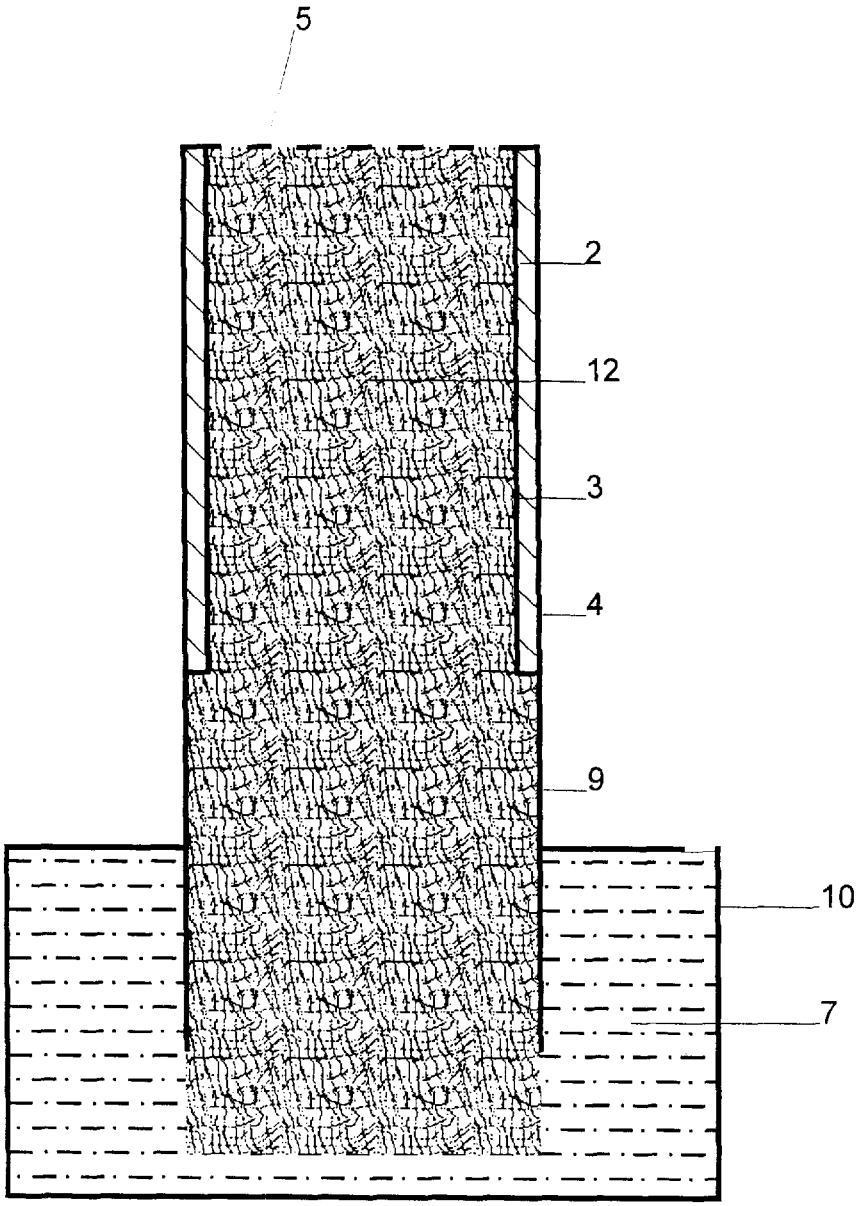
FIG. 3 shows a further example, also in section.

Alternatively fluid may be fed to the perforate structure 5 using a capillary wick 12, illustrated in FIG. 3.

In some applications, for example unit-dose intra-nasal drug delivery, it may be desirable to separate the unit into two parts. The first, disposable, part may for example consist of the fluid, its container and the perforate structure. The second part, which is reusable, may correspondingly consist of the actuator together with its drive electronics and power source.

Figure 4:
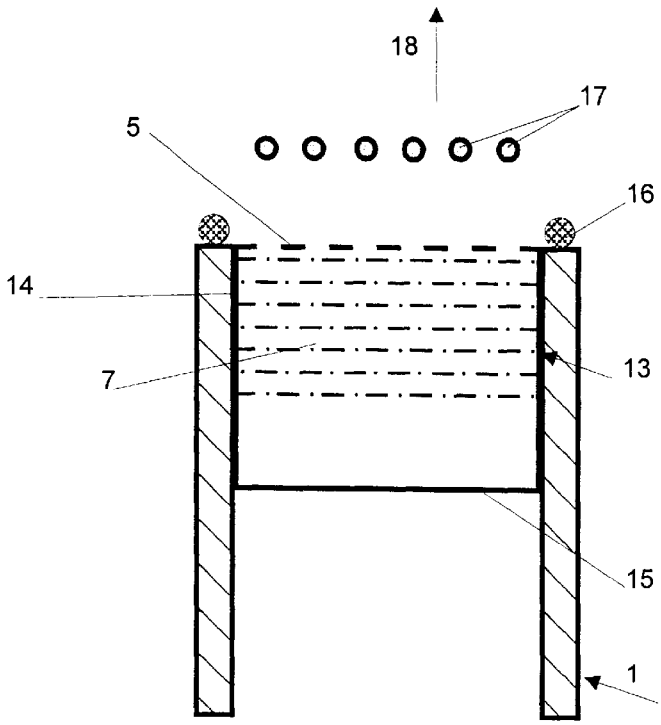
FIG. 4 shows a further example, but of a two-section device, in longitudinal section.

FIG. 4 shows one example of such a split. In this case, the disposable part 13, which may be stored in a hermetically sealed sterile container, consists of the fluid 7, a container 14, a perforate structure 5, and an air-permeable sub-micron membrane 15.

In operation it is placed into the reusable actuator 1 and gripped against the actuator at the perforate structure perimeter. To dispense fluid the actuator is driven so exciting the perforate structure by a suitable mounting structure 16. Droplets 17 are generated in the direction of arrow 18 and air is drawn into the container through the sub-micron membrane 15. The drive time may be chosen either so that the dose is dispensed as one continuous dose or, in the case of a bi-dose system, in two separate doses.

Figure 5:
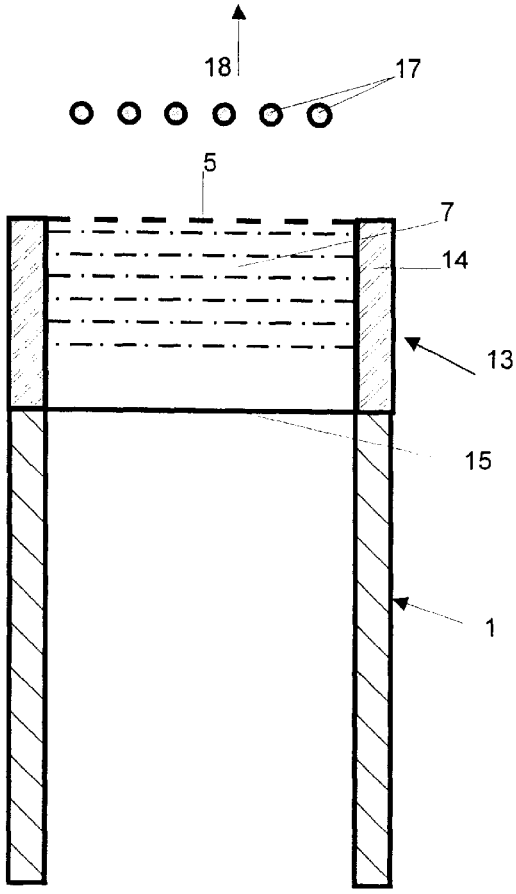
FIG. 5 is a section illustrating a second split device.

FIG. 5 shows a second example of such a split. Here the motion of the actuator 1 is coupled to the perforate structure 5 via the walls of the disposable casing 14.

Figure 6:
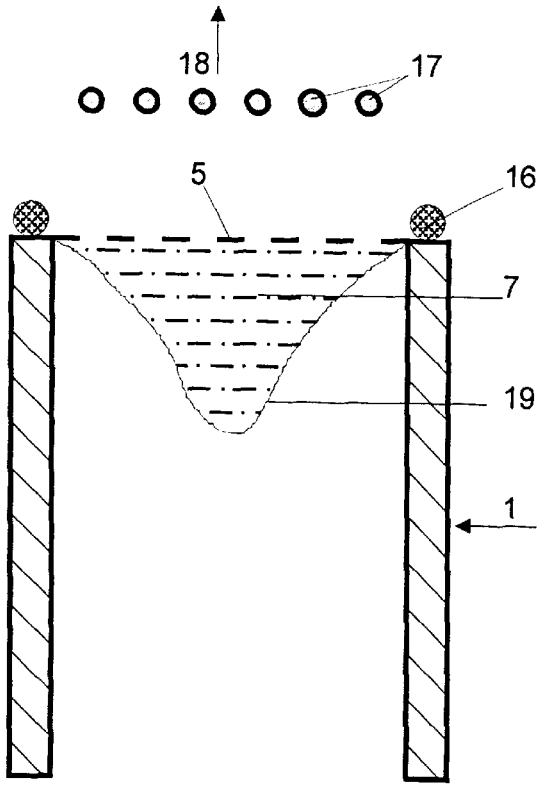
FIGS. 6 and 7 are sections illustrating third and fourth split devices.

FIG. 6 shows a third example of such a split. Here the fluid container consists of a collapsible bag 19. As the fluid is dispensed the bag collapses to give almost complete emptying of the container. Coupling of the actuator to the perforate structure may be direct, as shown in FIG. 6, or via a thin walled short or ring 20 tube bonded to the perforate structure and surrounding the fluid bag, as shown in FIG. 7.

Figure 7:
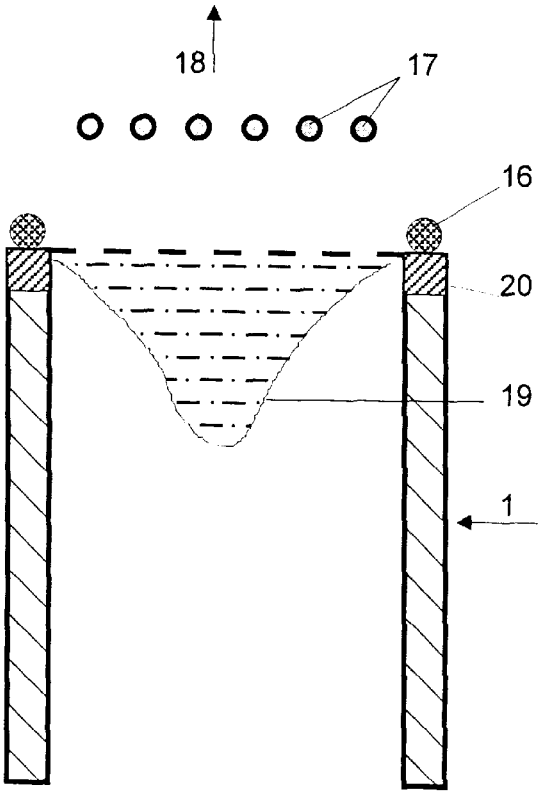
Figure 8:
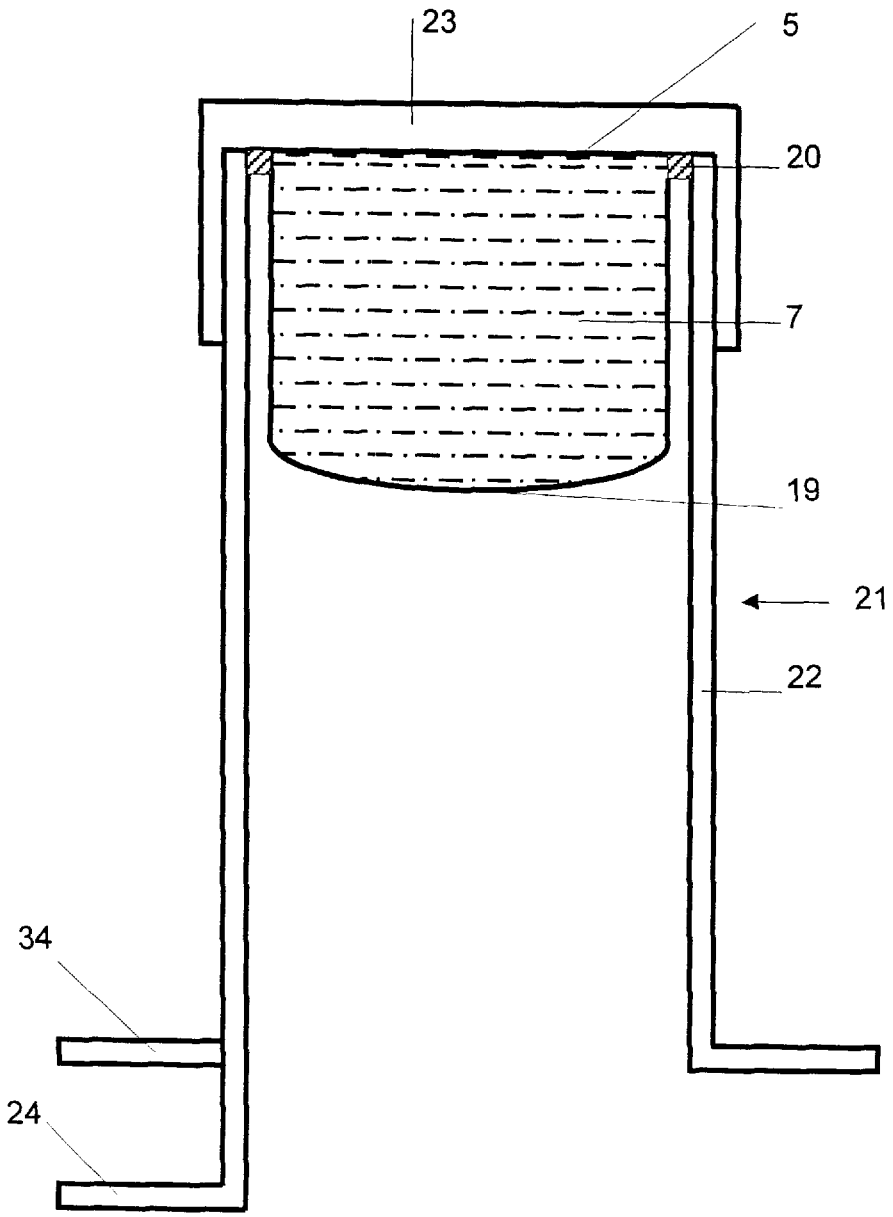
FIGS. 8 to 10 show, in section, a practical design for an intra-nasal drug delivery device.
Figure 9:
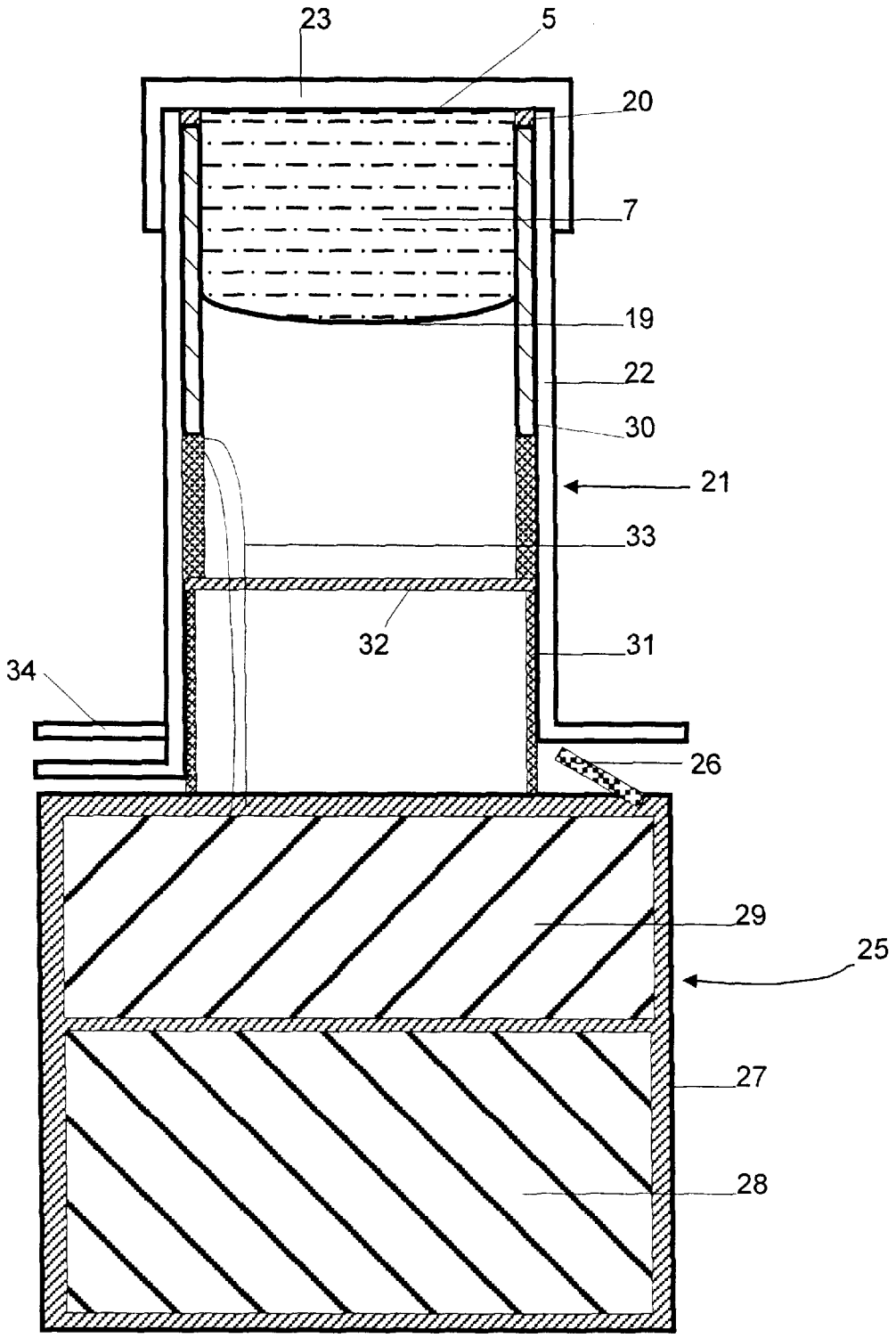
Figure 10:
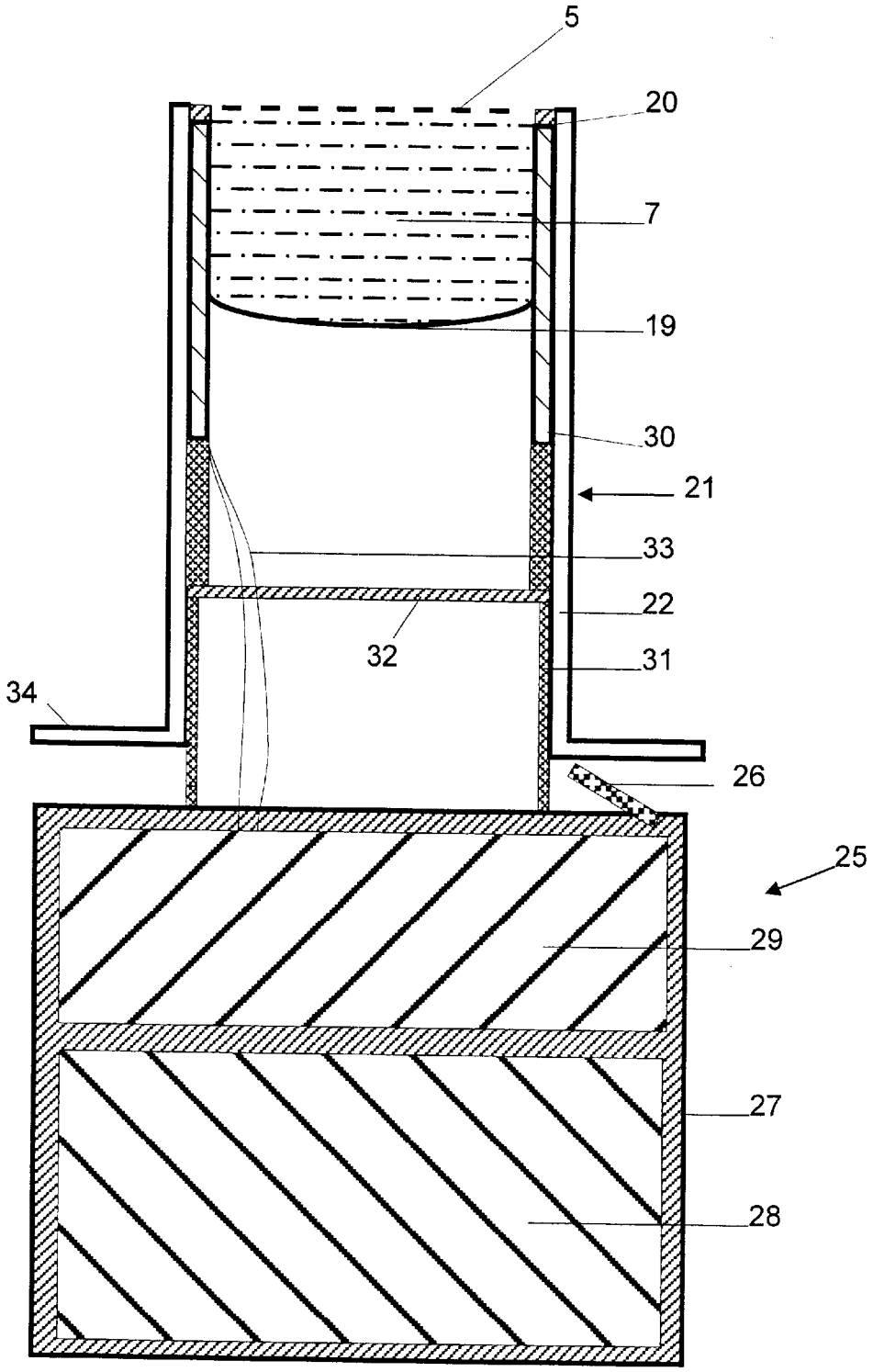

FIGS. 8, 9 and 10 show how the design of FIG. 7 might be turned into a practical intra-nasal drug delivery device. FIG. 8 shows the disposable section, FIG. 9 the assembled delivery unit and FIG. 10 the assembled unit with the protective end cap removed.

The disposable part 21 incorporates a cylindrical nasal delivery tube 22 and hermetically sealed cap 23. The cap incorporates an end stop 24 which prevents an electrical switch being activated until the cap is removed. The end stop also gives the cap sufficient size to prevent it from being ingested or inhaled.

In operation, the user screws the disposable part 21 onto the drive unit 25 and removes the cap 23 from the disposable part. He or she then inserts the nasal delivery tube 22 into one of their nostrils and activates the actuator by compressing the lower section of the disposable part against a micro-switch 26. The device then delivers the drug as an aerosol into the nasal cavity.

The drive unit 25 comprises a housing 27, containing a battery 28 and an electronic drive 29, and a tubular piezoelectric actuator 30 mounted on an upwardly extending tube 31. A bulkhead wall 32 separates the fluid-containing part of the disposable portion 21 from the drive unit interior. Electrical connections 33 pass through the bulkhead from the drive electronics 29 to the actuator 30. A finger grip 34 allows convenient one-handed operation. Thus by incorporating the actuation switch into the housing 27, one may insert the device up a nostril and compress the finger grip to dispense the dose.

Figure 11:
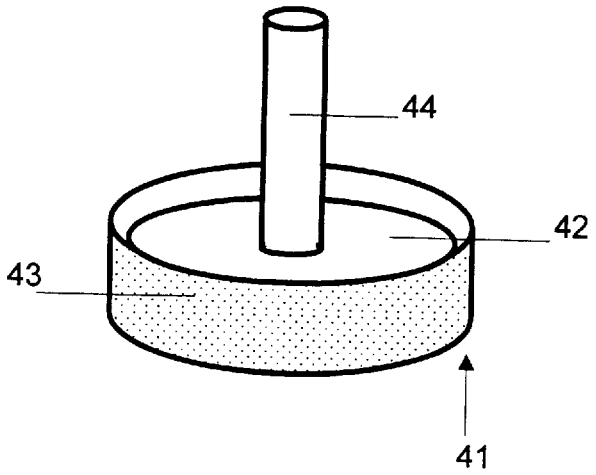
FIG. 11 shows an alternative actuator diagrammatically.

FIG. 11 shows an alternative actuator embodiment. The actuator 41 is formed from a piezoelectric disc 42 with thickness much smaller than its diameter. It is metallised on the two planar surfaces to provide electrodes. The perforated structure 43 takes an annular form that is affixed about its central plane to the actuator's perimeter. In operation fluid is fed via feed 44 to the perforate structure which is excited radially by driving the actuator.

Figure 12:
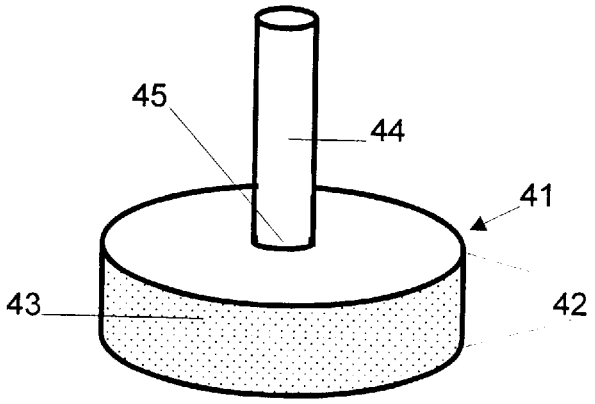
FIG. 12 shows a modification to the actuator of FIG. 11.

FIG. 12 shows a similar structure where the actuator now consists of two discs 42 and the perforate structure 43 is attached at its edges to the actuators perimeter. Fluid is fed to inner surface of the perforate structure 43 via a central hole 45 drilled in one of the actuators. Again droplets are generated by exciting the actuator and driving the perforate structure radially.

Figure 13A:
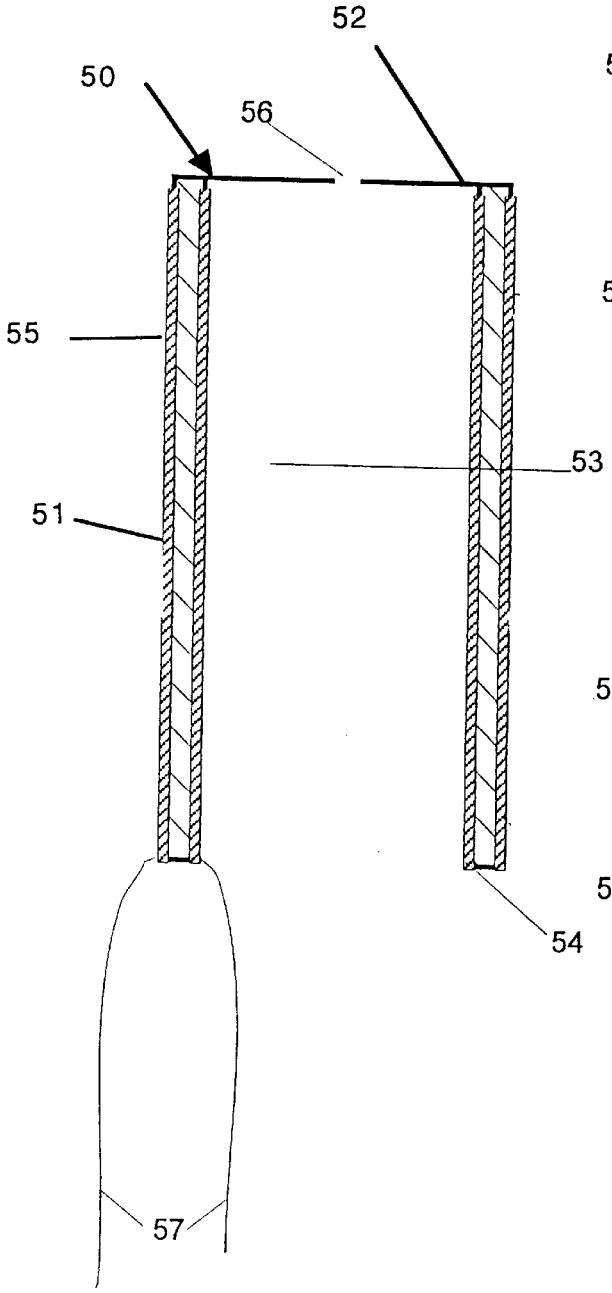
FIG. 13A is a cross-section of the device illustrated in FIG. 13.
Figure 13:
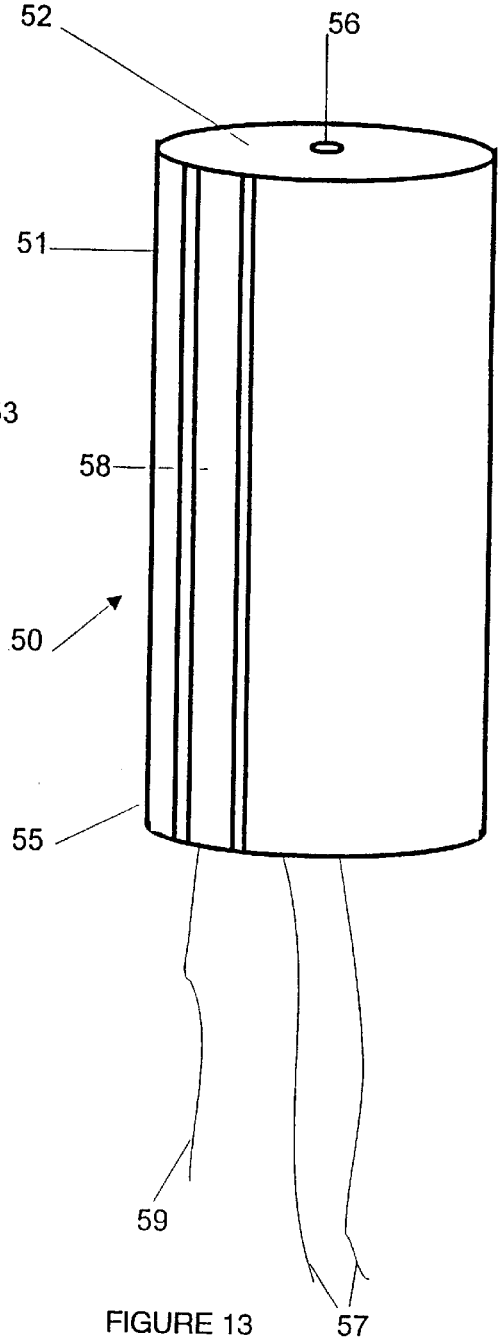
FIG. 13 shows a pen head suitable for use as a writing instrument.

Part of a device (the pen head 50) suitable for an ink jet pen, hand-held marking instrument, hand-held printer or compact graphics tool is shown in FIG. 13. It consists of a tubular piezoelectric actuator 51, a nozzle plate 52 having a single nozzle 56 and a capillary foam ink feed 53. It may be driven, through electrodes 54,55 via conductors 57, continuously to generate a continuous ink droplet stream; the continuous drive signal may be in the form of continuous sine waves or other continuous waves. The device may also be driven with pulses to generate drops on demand. The pulse may consist of a half cycle, a full cycle, a train of half cycles or full cycles, a synthesized waveform or a train of synthesised waveforms. When driven with pulses, we may choose the pulse cycle period to correspond to a natural frequency of oscillation of the composite transducer.

A sense electrode 58 can be provided, signals from it being fed through conductor 59.

The nozzle plate 52 may have a single orifice 56 (as shown) or a pattern of orifices, laid out, for example, in a line, circle or other pattern. The plate 52 may be designed so that all of the nozzles eject a drop upon actuation or so that different nozzles eject a drop according to the drive signal. For example, at some operating frequencies and with a linear nozzle pattern on a suitable nozzle plate, the central nozzle will generate a drop when the piezoelectric actuator is driven by a relatively weak drive signal. As the drive signal is increased the adjacent nozzles become active and thus a wider line is generated. The design is therefore able to offer an ink jet pen with variable line width. The drive signal may be controlled either by the finger pressure applied to the pen or by the pressure applied to a sensor on the substrate or by some other means.

The pen can also offer varied grey levels by varying the frequency of drop generation and the drop volume in each DOD delivery. These may also be used advantageously to vary the line width.

Figure 14:
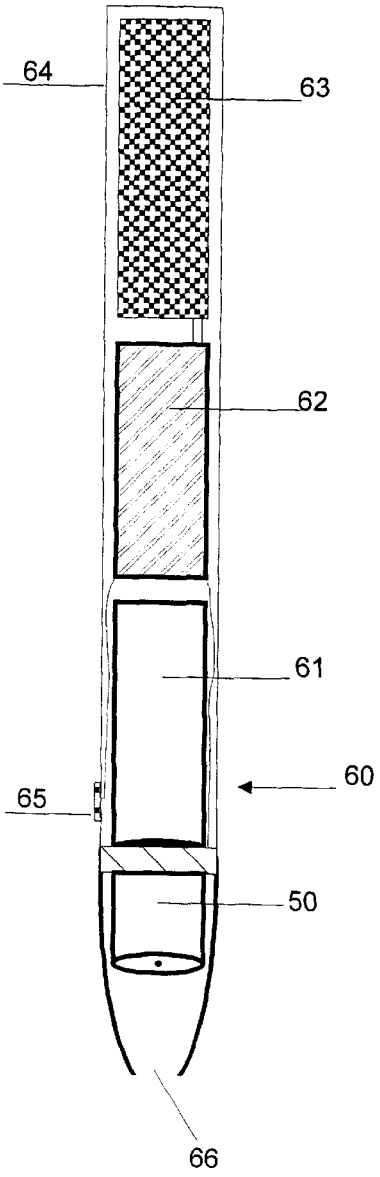
FIGS. 14 and 15 illustrate writing instruments in more detail.

An implementation of the pen head into a writing instrument 60 is shown in FIG. 14. The writing instrument 60 contains the pen head 50, an ink reservoir 61 that feeds ink to the pen head, drive electronics 62 and a battery 63, all retained in a casing 64. The pen is actuated by a finger switch 65 shown on the pen casing to cause ink to be emitted through the exit aperture 66.

In a preferred embodiment the pen head 50 incorporates a piezoelectric tube 51 of PC5H lead zirconate titanate ceramic sourced from Morgan Matroc Unilator. It has an ID of 3.2 mm, an OD of 4.2 mm and a height of 12.7 mm. The nozzle plate is made from nickel, it has a diameter of 4.0 mm, a thickness of 0.23 mm and a centrally placed orifice of 50 microns. The capillary wick 53 is made of Basotect, which can be obtained from BASF. The ink used is Hewlett Packard Deskjet ink.

In operation the piezoceramic may be driven continuously at 75 kHz to deliver a continuous stream of droplets at 75 kHz. It may also be driven in a drop-on-demand mode. When driven in drop-on-demand (DOD) mode the piezo must be driven to achieve an amplitude and acceleration at the nozzle plate that achieves single drop generation. This may be done in a number of ways. For example the piezo may be driven with a single square pulse of appropriate height and width, for example, 200 V and 6.4 $\mu$s. Alternatively, the piezo may be pumped up to an appropriate amplitude by driving with a number of cycles or half-cycles of lower amplitude, for example two full square wave cycles, for example of height 100 V and period 12.8 $\mu$s. By placing an inductor with an appropriate inductance in series with the piezoelectric ceramic, the drive voltage may be reduced still further. For example, by placing a 700 $\mu$H inductor in series with the piezo, in the same embodiment we can reduce the drive voltage to 27 V whilst maintaining the square wave form with 12.8 $\mu$s period, again driving over two full cycles. The advantage of this second approach is that lower voltages are applied to the device and this significantly simplifies the design and reduces the cost of both the drop generator and the electronics. It is possible to vary the drop size by an appropriate variation of the drive conditions, for example by varying the signal amplitude over a factor of two. Repetition frequencies of 3 kHz have been obtained in this DOD mode.

Figure 15:
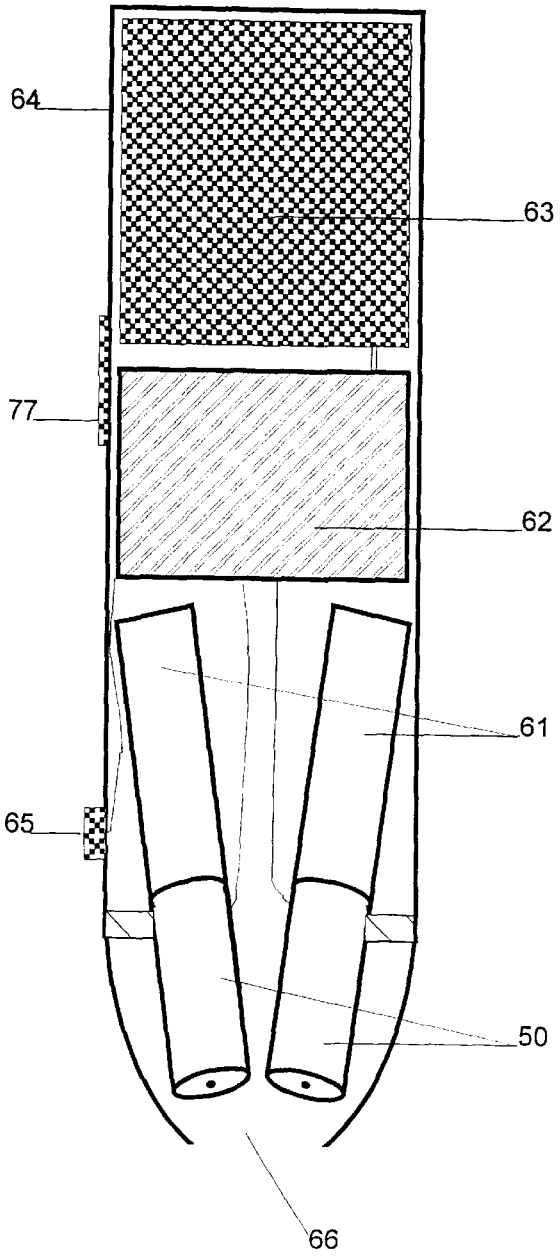

An embodiment of the technology incorporated into a colour pen is shown in FIG. 15. The same reference numerals are used where appropriate. Three heads 50 are separately controlled and each feeds from a reservoir 61 of a different colour ink. The heads and reservoirs are separately mounted in the pen and angled so as to converge close to the pen exit aperture 66. The pen is again actuated by a finger switch 65 mounted on the barrel. The colour and line thickness are varied by controls 77 also mounted on the pen.

Figure 16:
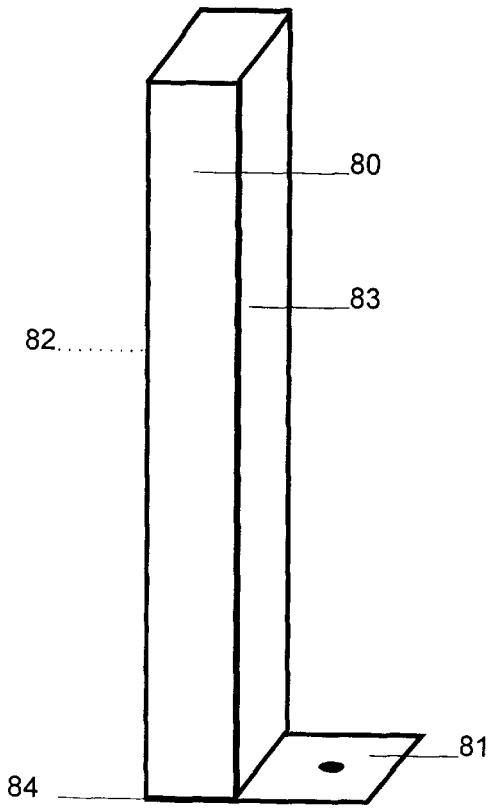
FIGS. 16 to 19 illustrate, schematically a further type of actuator and arrangements for its use.

To minimise the footprint and create a low cost implementation that is suitable for building as an array, the nozzle plate may be attached to the end of a linear (rod-shaped) piezo-ceramic 80, as shown schematically in FIG. 16. The nozzle plate 81 is typically twice the area of the base of the piezoelectric rod and two are attached by adhesive 84. Electrodes 82,83 are provided on opposite sides of the piezo-ceramic 80.

The individual units may be laid out in a one or two dimensional array to give individually addressable nozzles, as one might employ for printing, drawing and graphic applications.

By combining the printhead with various sensors and processing electronics, a number of advanced features can be obtained.

Sensors that may be incorporated include:

- a pressure sensor (sensitive to pressure on the page and/or finger pressure on the barrel)
- a motion sensor
- a velocity sensor (measuring speed and/or direction of travel)
- an accelerometer (in one, two or three axes)
- an orientation sensor.

These in conjunction with the head and processing electronics offer features including the following:

- Italic writing: for example the pen draws thick lines on the up-stroke and down stroke and thin lines when moved from side to side.
- Labelling using a data link: data is sent down a cable or by a radio link to the pen. The message is printed by sweeping the pen over a label or other substrate.
- Colour printing: the pen uses a number of coloured inks which could either go to different nozzles and thus be electrically addressed or be mechanically switched.
- Paintbrush: the active colour is set either electronically or mechanically so allowing a single writing instrument to generate any desired colour.
- Grey levels: the drop size and frequency can be controlled to give lines of variable grey level.
- Fixed patterns: a textured line pattern can be generated by making groups of nozzles, set out in a fixed pattern, generate a drop upon actuation of a single piezoelectric element.
- Variable line width: line width may be varied either by controlling the number of active elements in an array or by coupling a number of nozzles to a single element. The different nozzles may be brought into action by varying the drive amplitude or drive waveform.

The benefit of this technology over other systems, such as bubble jet, is that this technology offers a far smaller footprint. For example, a single nozzle device can be as small as a 0.5 mm square. An array can be as long as desired, 7 mm for example, but remain only 0.5 mm to 1.0 mm wide. This offers a very significant advantage for a writing instrument, where it is highly advantageous for the user to be able to view the writing point.

Figure 17:
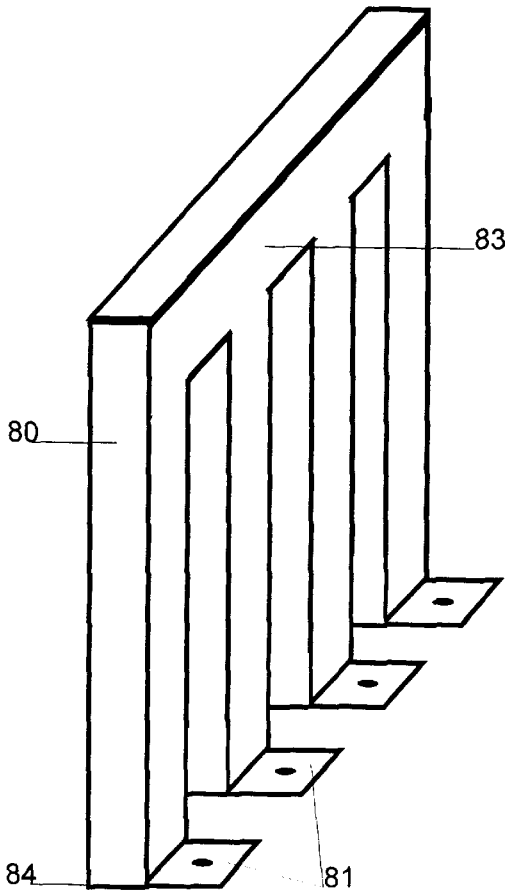

FIG. 17 shows a practical way of achieving a high resolution array. Here the piezoelectric rods 80 are cut from a single sheet of piezoelectric material. The sheets are metallised so that one side 83 of the sheet is electrically commoned and on the other side, the outer electrode of each rod 80, is made individually addressable. In a typical device the piezo rods are 10 mm high, 0.25 mm thick, and 0.1 mm wide, with an inter rod distance of 0.1 mm.

Figure 18:
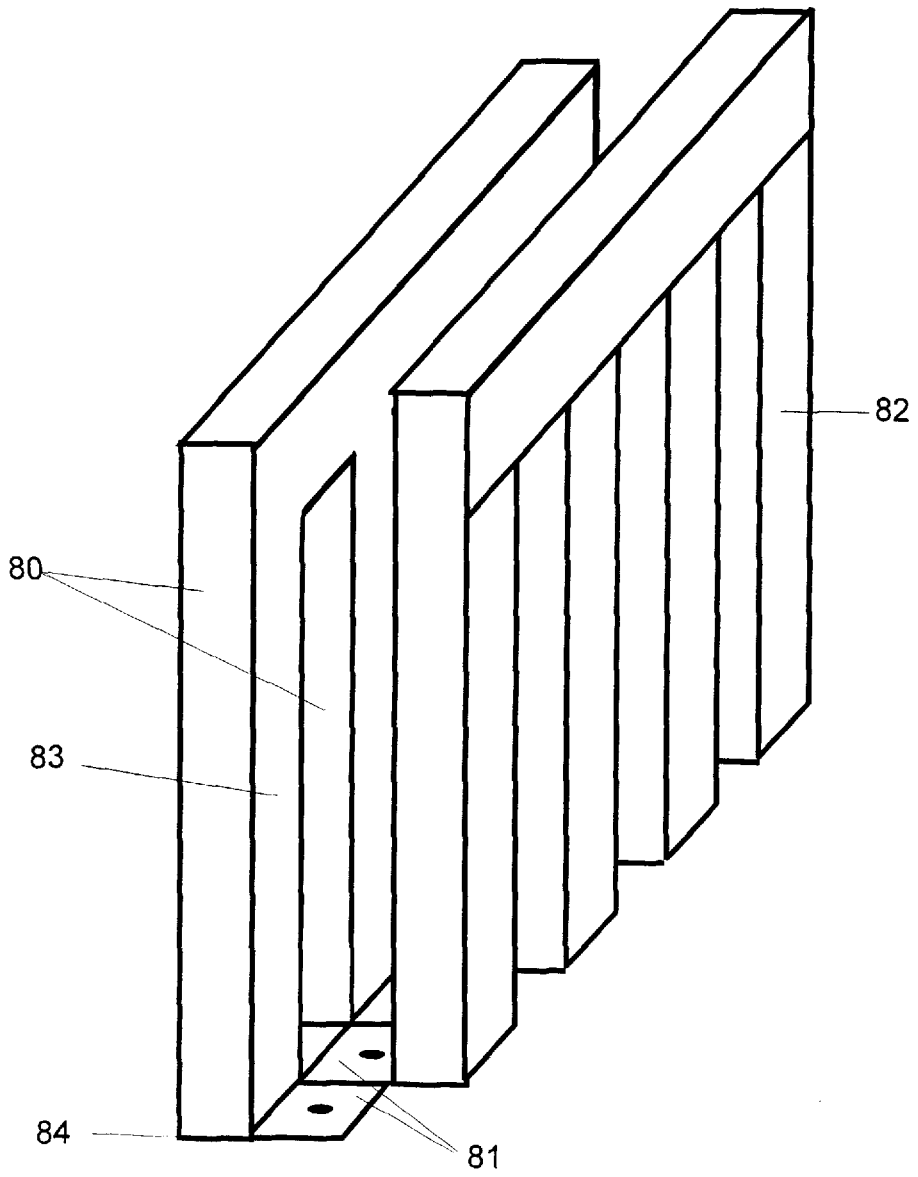

A higher resolution can be achieved by interleaving two such sheets as shown in FIG. 18.

Figure 19:
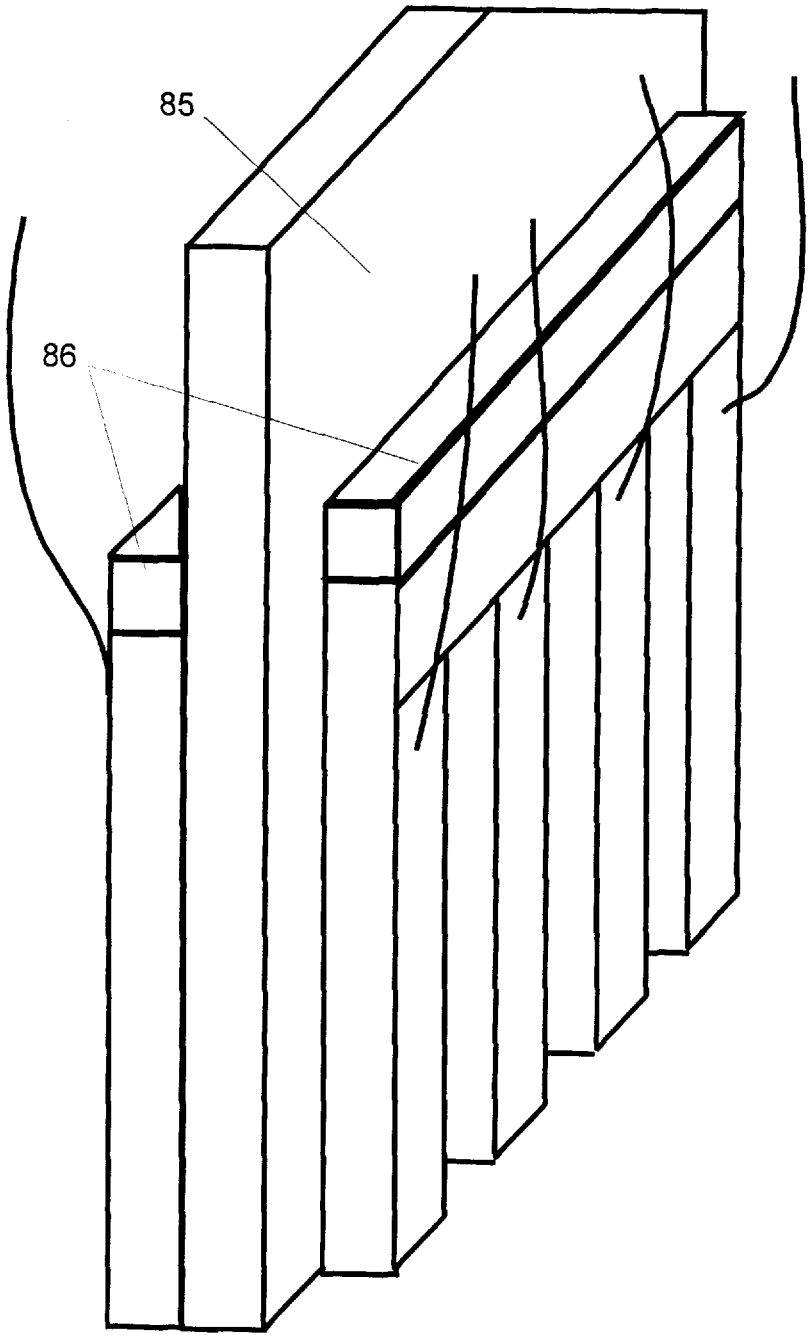

FIG. 19 shows one way in which the fluid can be supplied to the nozzles via a capillary wick 85. The printhead is held in the body of the pen by rubber mountings 86 at the top of the actuator. Silicone rubber 3481 from General Electric is suitable, Typically, the mounting may be 1 mm wide, 1 mm thick and runs the length of the printhead.

Alternatively the small inter-slab separation, 0.2 mm for example, can be used as the final fluid feed system with a capillary or other feed system further upstream.

A high resolution colour system can be achieved by placing three or four of these sub-assemblies back to back.

Figure 20:
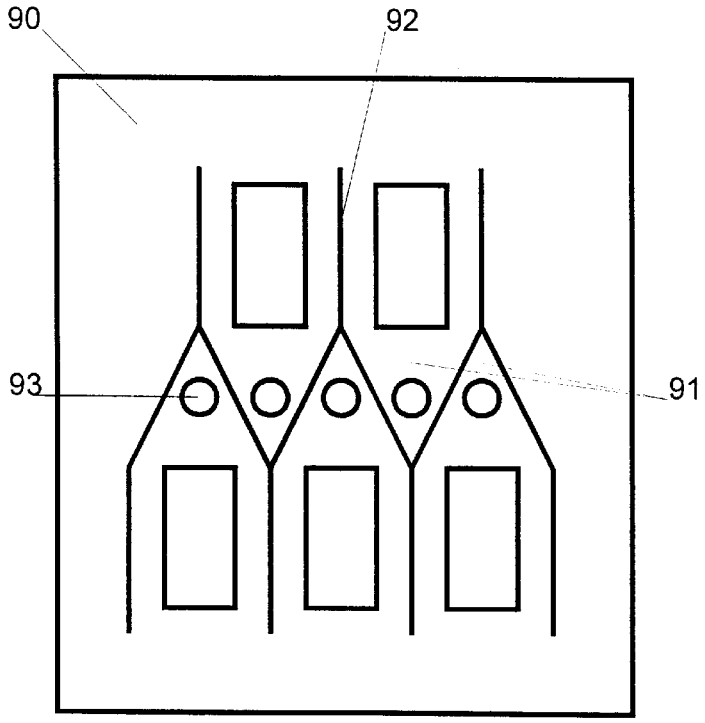
FIG. 20 illustrates a construction of multiple nozzle plates formed in a common sheet.

To facilitate fabrication, the nozzle plates can all be created in a connected sheet of metal. One form of this is shown in FIG. 20. Here the different nozzle plates 91 are isolated from each other by slits 92 in the metal sheet 90. Upon actuation fluid drops are forced through the nozzles 93, but are prevented from moving through the narrower slits 92 by surface tension and viscosity. In one embodiment the sheet 90 is 2 mm wide 7 mm long and 0.1 mm thick. The nozzles 93 are 50 microns in diameter and the isolating slits 92 are 10 microns wide. The slits may be formed by electroforming or etching. Each of the plates 91 is connected to the bottom of a piezoelectric rod 80.

We claim:

1. A device for generating droplets of fluid, the device comprising:

a fluid supply means;

an electromechanical transducer having electrodes arranged so as to operate in extensional mode to cause expansion or contraction of the transducer in a dimension perpendicular to the applied electric field; and an element coupled for movement with the expansion/contraction of the transducer in the direction of said dimension and positioned for contact with fluid from the supply means, said fluid supply means being adapted to supply fluid to said element at a pressure at most equal to ambient pressure.

2. A device according to claim 1, wherein the element comprises a vibratable, perforated membrane.

3. A device according to claim 1, wherein the movable element is imperforate.

4. A device for generating droplets of fluid, the device comprising:

an electromechanical transducer;

a fluid supply means, said fluid supply means including a container for fluid; and an element coupled for movement with the transducer and positioned for contact with fluid in said container;

wherein the movable element is removably mounted relative to the transducer and said container.

5. A device according to claim 2, wherein the movable element is a perforate plate.

6. A device according to claim 4, wherein the movable element is imperforate.

7. A device according to claim 2, wherein the movable element has a profiled surface.

8. A device according to claim 2, wherein the dimension in which the transducer is expandable or contractible is much greater than at least one other dimension of the transducer.

9. A device according to claim 4, wherein the transducer is tubular and is expandable or contractible in the direction of its central axis.

10. A device according to claim 4, wherein the transducer is disc-shaped or annular and is expandable or contractible in the radial direction.

11. A device according to claim 4, wherein the supply means incorporates a collapsible thin-walled structure.

12. A device according to claim 4, wherein the movable element is connected with the fluid supply means to form a replaceable sub-assembly or fluid cartridge assembly.

13. A device according to claim 4, wherein the transducer has electrodes disposed across those two surfaces which give the shortest interelectrode distance, and the transducer has a length which is much greater than that interelectrode distance, so that it is the length extension of the actuator that is used to excite the perforate membrane.

14. A device according to claim 4, wherein the actuator/transducer is a piezoelectric or electrostrictive element which comprises a plate-like member, a rectangular cross-sectioned rod, or a hollow tube with length greater than the separation between its inner and outer radii.

15. A device according to claim 14, wherein the actuator/transducer is a hollow tube having electrodes situated on the inner and outer walls and being poled radially.

16. A device according to claim 14, wherein the actuator/transducer is a rectangular cross-sectioned rod having electrodes situated on the two closest faces.

17. A device according to claim 4, adapted and arranged to be operated as a drop-on-demand device.

18. A writing instrument incorporating a device according to claim 4.

19. A printing or marking device incorporating a plurality of devices according to claim 4, the devices being arranged in a one or two dimensional array.

20. A printing or marking device according to claim 16, wherein the coupled element comprises a nozzle plate provided at one end of the rod and having a portion extending transversely therefrom in which is formed one or more orifices.

21. A printing or marking device comprising one or more rows of devices according to claim 20.

22. A printing or marking device according to claim 20, having a pair of rows of devices wherein the transversely extending portions of the nozzle plates of the two rows are interdigitated with one another.

23. A printing or marking device according to claim 22, wherein the nozzle plates are formed integrally with one another in a single sheet and are separated from one another by slits formed therebetween.

24. A device according to claim 4, wherein the element comprises a vibratable mass.

25. A device according to claim 4, wherein the transducer is operable in an extensional mode.

26. A device according to claim 4, wherein the fluid supply is operable at a pressure at most equal to ambient pressure.

* * * * *